US008205298B2

(12) United States Patent
Lin et al.

(10) Patent No.: US 8,205,298 B2
(45) Date of Patent: Jun. 26, 2012

(54) HINGE

(75) Inventors: Xin-Hong Lin, Jiangsu (CN); Shu-Hua Lin, Jiangsu (CN); Shu-Juan Lin, Jiangsu (CN); Shu-Jun Du, Jiangsu (CN)

(73) Assignee: Kunshan Hu Hua Metal Products Co., Ltd., Jiangsu (CN)

( * ) Notice: Subject to any disclaimer, the term of this patent is extended or adjusted under 35 U.S.C. 154(b) by 367 days.

(21) Appl. No.: 12/581,285

(22) Filed: Oct. 19, 2009

(65) Prior Publication Data

US 2011/0072617 A1 Mar. 31, 2011

(30) Foreign Application Priority Data

Sep. 25, 2009 (TW) ..... 98217778 A

(51) Int. Cl.
*E05F 1/08* (2006.01)

(52) U.S. Cl. ..... 16/287; 16/82; 16/245

(58) Field of Classification Search ..... 16/286–288, 16/235–238, 242, 245, 246, 54, 68, 50, 82; 312/326
See application file for complete search history.

(56) References Cited

U.S. PATENT DOCUMENTS

| | | | | |
|---|---|---|---|---|
| 6,591,454 | B2 * | 7/2003 | Brustle | 16/374 |
| 7,065,833 | B2 * | 6/2006 | Kropf | 16/286 |
| 7,243,394 | B2 | 7/2007 | Kao | |
| 7,275,284 | B2 * | 10/2007 | Lautenschlager et al. | 16/287 |
| 7,406,749 | B2 * | 8/2008 | Herper | 16/368 |
| 7,555,815 | B2 | 7/2009 | Tate, Jr. et al. | |
| 7,562,416 | B2 * | 7/2009 | Lautenschlager et al. | 16/286 |
| 7,575,195 | B2 | 8/2009 | Eveker et al. | |
| 7,669,285 | B2 * | 3/2010 | Gallasch et al. | 16/286 |
| 7,712,185 | B2 * | 5/2010 | Pyo | 16/286 |
| 2011/0005032 | A1 * | 1/2011 | Domenig et al. | 16/54 |
| 2011/0154609 | A1 * | 6/2011 | Liao | 16/54 |

FOREIGN PATENT DOCUMENTS

| | | | |
|---|---|---|---|
| CN | 201513043 U | * | 6/2010 |
| CN | 201635559 U | * | 11/2010 |
| CN | 201649920 U | * | 11/2010 |
| KR | 2009000915 U | * | 2/2009 |
| TW | M307673 | | 3/2007 |

* cited by examiner

*Primary Examiner* — William L. Miller
(74) *Attorney, Agent, or Firm* — Alan Kamrath; Kamrath IP Lawfirm, PA

(57) ABSTRACT

A hinge includes a base receiving a coupling device detachably mounted onto a mounting seat. An outer resilient plate includes an end pivotably mounted onto the base. A fixed seat is pivotably mounted onto the other end of the outer resilient plate. A buffer device includes a connecting member, a buffer, and an inner resilient plate. Each of a first pivot hole of the connecting member, an end of the buffer, and an end of the inner resilient plate is pivotably mounted onto the base. The other end of the buffer is pivotably mounted onto a second pivot hole of the connecting member. The other end of the inner resilient plate is slideably mounted onto an arcuate slot of the connecting member. The inner resilient plate further includes a fulcrum pivot hole intermediate the ends thereof. The fulcrum pivot hole is pivotably mounted by a pivot to the base.

9 Claims, 5 Drawing Sheets

HINGE

BACKGROUND OF THE INVENTION

1. Field of the Invention

The present invention relates to a hinge and, more particularly, to a hinge mounted between a door and a cabinet body of a piece of furniture to provide a buffering function avoiding the door from impacting the cabinet and to allow easy assembly and detachment of the door.

2. Description of the Related Art

A type of hinge includes a fixed seat fixed to a door of a piece of furniture. A connecting frame is fixed to a cabinet body of the furniture. A buffer unit is mounted between the fixed seat and the connecting frame via a connecting device. When the door is being closed, the buffer unit provides a buffering effect to reduce the speed the door is being closed, avoiding the cabinet from being damaged by the door when the door is closed at a high speed. The buffer unit includes a buffer, a swivel member, and a plurality of swaying plates. The buffer and the swivel member are pivotably mounted onto the connecting frame. The buffer is pivotably connected to the swaying plates via the swivel member thereby allowing the swivel member to move in a reciprocating manner. Each swaying plate is pivotably connected to a plurality of connecting plates of the connecting device. The connecting plates are overlapped and pivotably mounted between the fixed seat and the connecting frame. Two of the connecting plates include lugs with pivot holes for pivotal connection with the swaying plates. An example of such a hinge is disclosed in Taiwan Utility Model No. M307673. However, the pivotal angle of the buffer is relatively large during opening or closing of the door, such that a large space must be provided between the connecting frame and the fixed seat to avoid interference between the elements of the buffer unit, preventing a bulky device from being required. Furthermore, the hinge includes a number of components and requires troublesome assembly of the overlapped connecting plates in sequence. Further, since there are four pivotal connections between the buffer, the swivel member, the swaying plates, and the connecting plates and since each swaying plate is a free member having its own rotational and translational movement, the movements of the pivotal connections may interfere with each other, leading to non-smooth closing or opening of the door.

SUMMARY OF THE INVENTION

An objective of the present invention is to provide a hinge including a connecting member having an arcuate slot slideably receiving a pivot providing a pivotal connection between the connecting member and an inner resilient plate to reduce the pivotal angle of the buffer and to reduce the overall volume of the hinge.

Another objective of the present invention is to provide a hinge including a connecting member pivotably mounted between a buffer and an inner resilient plate to provide a simplified structure while allowing easy assembly.

A further objective of the present invention is to provide a hinge including a buffer, a connecting member, and an inner resilient plate that have only two pivotal connections therebetween. Furthermore, the connecting member is pivotably mounted onto a base and limited to a fixed angular movement to avoid interference between the pivotal connections.

The present invention fulfills the above objectives by providing, in a preferred form, a hinge including a base having a pivotal portion. A coupling device is received in the base and includes a coupling portion. A mounting seat includes an assembling portion to which the coupling portion of the coupling device is detachably mounted. An outer resilient plate includes an end pivotably mounted onto the base. A fixed seat is pivotably mounted onto the other end of the outer resilient plate. A buffer device includes a connecting member, a buffer, and an inner resilient plate. The connecting member includes a connecting plate having a first pivot hole, a second pivot hole, and an arcuate slot. The first pivot hole, the second pivot hole, and the arcuate slot are non-colinear. Each of the first pivot hole of the connecting member, an end of the buffer, and an end of the inner resilient plate is pivotably mounted onto the pivotal portion of the base. The other end of the buffer is pivotably mounted onto the second pivot hole of the connecting member. The other end of the inner resilient plate is slideably mounted onto the arcuate slot. The inner resilient plate further includes a fulcrum pivot hole in an intermediate portion thereof. The fulcrum pivot hole is pivotably mounted by a pivot to the pivotal portion of the base.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
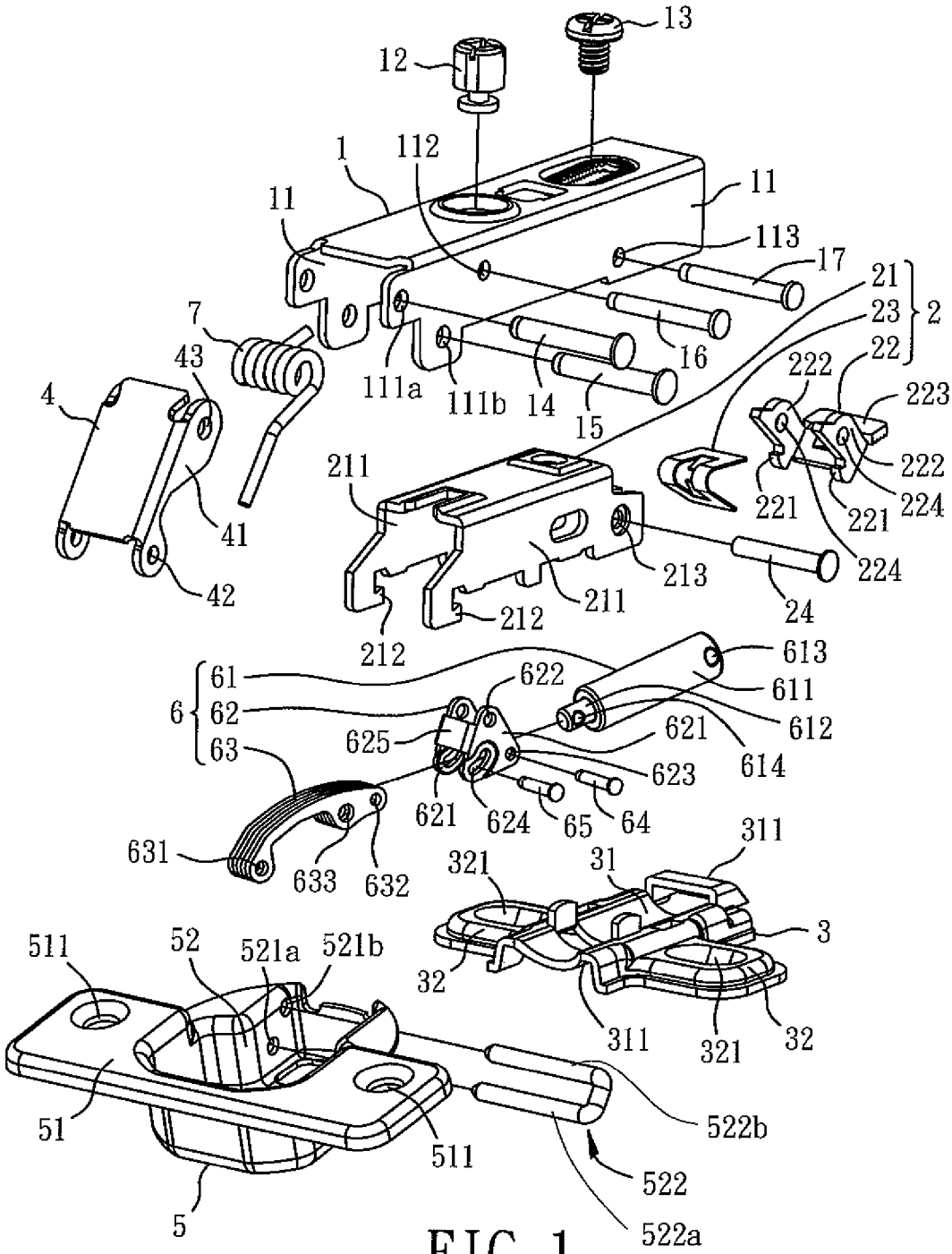
FIG. 1 shows an exploded perspective view of a hinge according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "axial", "lateral", "inward", "outward", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A hinge according to the preferred teachings of the present invention is shown in the drawings and generally includes a base 1, a coupling device 2, a mounting seat 3, an outer resilient plate 4, a fixed seat 5, and a buffer device 6. The coupling device 2 is mounted in the base 1 to allow the base 1 to be detachably mounted onto the mounting seat 3. The outer resilient plate 4 and the buffer device 6 are pivotably mounted between the base 1 and the fixed seat 5. The mounting seat 3 is mounted onto a cabinet body 80 of a piece of furniture 8. The fixed seat 5 is mounted onto a door 82 of the furniture 8. When the door 82 is being closed, the buffer device 6 provides a buffering effect to reduce the speed the door 82 is being closed, thereby avoiding the cabinet body 80 from being damaged by the door 82 when the door 82 is closed at a high speed.

Specifically, the base 1 includes a pivotal portion in the preferred form shown as two lateral walls 11 that are parallel and spaced from each other in the preferred form shown. An end of each lateral wall 11 includes outer resilient plate pivot holes 111*a* and inner resilient plate pivot holes 11*b*. Each lateral wall 11 further includes a connecting member pivot hole 112 and a buffer pivot hole 113. Pivots 14, 15, 16, and 17 are respectively extended through the outer resilient plate pivot holes 111*a*, the inner resilient plate pivot holes 111*b*, the connecting member pivot holes 112, and the buffer pivot holes 113 of the lateral walls 11.

The coupling device 2 includes an inner seat 21, a coupling member 22, and a resilient member 23. The inner seat 21 includes two lateral walls 211 that are parallel and spaced from each other in the preferred form shown. A spacing between the lateral walls 211 of the inner seat 21 is smaller than that between the lateral walls 11 of the base 1. Each lateral wall 211 has first and second ends. The first end of each lateral wall 211 includes a hook 212. The second end of each lateral wall 211 includes a pivot hole 213. The coupling member 22 includes two hooks 221 facing inward of the inner seat 21, two lugs 222, and a pressing board 223 facing outward of the inner seat 21. Each lug 222 has a pivot hole 224. A pivot 24 is extended through the pivot holes 213 of the inner seat 21 and the pivot holes 224 of the coupling member 22, so that the lugs 222 of the coupling member 22 are pivotably mounted onto the lateral walls 211 and that the hooks 212 of the lateral walls 211 are aligned with the hooks 221 of the coupling member 22 to form a coupling portion. The resilient member 23 is in the form of an angled plate having two legs respectively pressing against the inner seat 21 and the coupling member 22, such that the hooks 221 of the coupling member 22 are biased toward the hooks 212 of the inner seat 21.

The mounting seat 3 includes a receiving portion 31 and at least two mounting portions 32 preferably on two sides of the receiving portions 31, respectively. The receiving portion 31 further includes two retaining portions 311 respectively located on two ends thereof. The two retaining portions 311 together form an assembling portion. The mounting holes 321 are formed in the mounting portions 32 to allow the mounting seat 3 to be mounted on the cabinet body 80 of the furniture 8.

The outer resilient plate 4 includes two lateral walls 41 each having first and second pivot holes 42 and 43. The pivot 14 extending through the outer resilient plate pivot holes 111*a* is extended through the second pivot holes 43, so that the base 1 and the fixed seat 5 are connected by the outer resilient plate 4.

The fixed seat 5 includes a plate portion 51 and a groove 52 in a middle portion of the plate portion 51 in the preferred form shown. The plate portion 51 includes a plurality of assembling holes 511 allowing the fixed seat 5 to be fixed to the door 82 of the furniture 8. After the fixed seat 5 is fixed to the door 82, the groove 52 is in a recess of the door 82. A peripheral wall of the groove 52 includes aligned outer resilient plate pivot holes 521*a* and aligned inner resilient plate pivot holes 521*b* through which a pivot 522 is extended. According to the preferred form shown, the pivot 522 is U-shaped and has a first leg 522*a* extending through the first pivot holes 42 of the outer resilient plate 4 and the outer resilient plate pivot holes 521*a* of the fixed seat 5, as well as a second leg 522*b* extending through the inner resilient plate pivot holes 521*b* of the fixed seat 5.

The buffer device 6 includes a buffer 61, a connecting member 62, and an inner resilient plate 63. The buffer 61 includes a buffer fixed seat 611 and a rod 612 movable relative to the buffer fixed seat 611 along an axial direction of the buffer fixed seat 611. The buffer fixed seat 611 includes a positioning hole 613 in an end thereof. The buffer fixed seat 611 further includes a receptacle 616 slideably receiving the rod 612. The rod 612 includes an outer end outside of the receptacle 616 and having a positioning hole 614. The pivot 17 extending through the buffer pivot holes 113 of the base 1 is extended through the positioning hole 613. The connecting member 62 includes at least one connecting plate 621. According to the preferred form shown, the connecting member 62 includes two connecting plates 621 and an intermediate plate 625 interconnected between the connecting plates 621, leaving a space between the connecting plates 621. The connecting plates 621 include the aligned first pivot holes 622, aligned second pivot holes 623, and aligned arcuate slots 624. The first pivot hole 622, the second pivot hole 623, and the arcuate slot 624 in each connecting plate 621 are non-colinear. The pivot 16 extending through the connecting member pivot holes 112 of the base 1 is extended through the first pivot holes 622. A pivot 64 is extended through the positioning hole 614 of the rod 612 and the second pivot holes 623. The inner resilient plate 63 includes first and second pivot holes 631 and 632 respectively in two ends thereof and a fulcrum pivot hole 633 between the first and second pivot holes 631 and 632. A pivot 65 is slideably extended through the arcuate slots 624 and extended through the second pivot holes 632 of the inner resilient plate 63. According to the preferred form shown, the connecting member 62 is pivotably mounted between the buffer 61 and the inner resilient plate 63. The pivot 64 extends through the positioning hole 614 of the rod 612 of the buffer 61 and the second pivot holes 623 of the connecting member 62. The pivot 65 extends through the second pivot hole 632 of the inner resilient plate 63, and the pivot 65 slideably extends through the arcuate slots 624.

According to the preferred form shown, a spring 7 is mounted onto the pivotal connection between the outer resilient plate 4 and the base 1. Specifically, the spring 7 includes a coil portion through which the pivot 14 extends. The spring 7 further includes two tangs respectively pressing against the outer resilient plate 4 and the base 1, biasing the outer resilient plate 4 and the base 1 away from each other.

Figure 2:
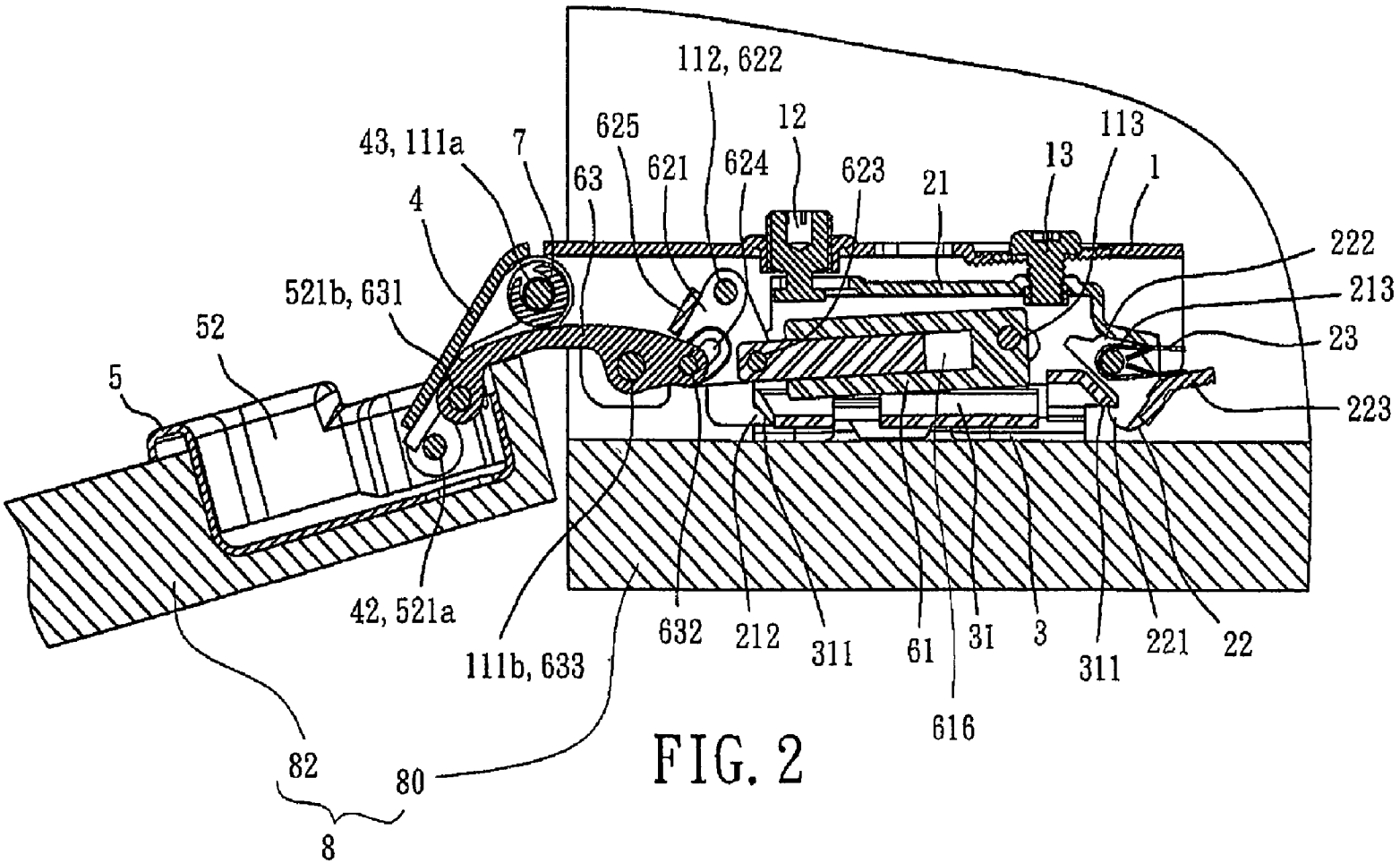
FIG. 2 shows a cross sectional view of the hinge of FIG I and a portion of a piece of a furniture to which the hinge is mounted, with a door of the furniture in an open position.

With reference to FIGS. 1 and 2, in assembly of the hinge according to the preferred teachings of the present invention, the fixed seat 5 is mounted onto the door 82 of the furniture 8 through the assembling holes 511, and the mounting seat 3 is mounted onto the cabinet body 80 of the furniture 8 through the mounting holes 321. Next, the inner seat 21 of the coupling device 2 is mounted between the lateral walls 11 of the base 1. An adjusting member 12 and a fixing member 13 are mounted between the base 1 and the inner seat 21 to allow adjustment in relative position between the base 1 and the inner seat 21.

An end of the buffer 61 of the buffer device 6 is pivotably mounted between the lateral walls 11 of the base 1 by extending the pivot 17 through the positioning hole 613 of the buffer fixed seat 611 and the buffer pivot holes 113 of the base 1. The connecting member 62 of the buffer device 6 is also pivotably mounted between the lateral walls 11 of the base 1 by extending the pivot 16 through the first pivot holes 622 of the connecting member 62 and the connecting member pivot holes 112 of the base 1. Then, the buffer 61 is pivotably mounted onto the connecting member 62 by extending the pivot 64 through the positioning hole 614 of the rod 612 and the second pivot holes 623 of the connecting member 62. Two ends of the inner resilient plate 63 of the buffer device 6 are respectively and pivotably mounted onto the connecting member 62 and the fixed seat 5. Specifically, the pivot 65 is extended through the second pivot hole 632 of the inner resilient plate 63 and the arcuate slots 624 of the connecting member 62 with the pivot 65 slideable in the arcuate slots 624. The second leg 522*b* of the pivot 522 is extended through the first pivot hole 631 of the inner resilient plate 63 and the inner resilient plate pivot holes 521*b* of the fixed seat 5. The pivot 15 is extended through the fulcrum pivot holes 633 and the inner resilient plate pivot holes 111*b* of the base 1. Two ends of the outer resilient plate 4 are respectively and pivotably mounted onto the base 1 and the fixed seat 5. Specifically, the pivot 14 is extended through the second pivot holes 43 in an end of the outer resilient plate 4 and the outer resilient plate pivot holes 111*a* of the base 1. The coil portion of the spring 7 is mounted around the pivot 14 with the first and second tangs of the spring 7 pressing against the outer resilient plate 4 and the base 1. The first leg 522*a* of the pivot 522 is extended through the first pivot holes 42 in the other end of the outer resilient plate 4 and the outer resilient plate pivot holes 521*a* of the fixed seat 5.

Figure 3:
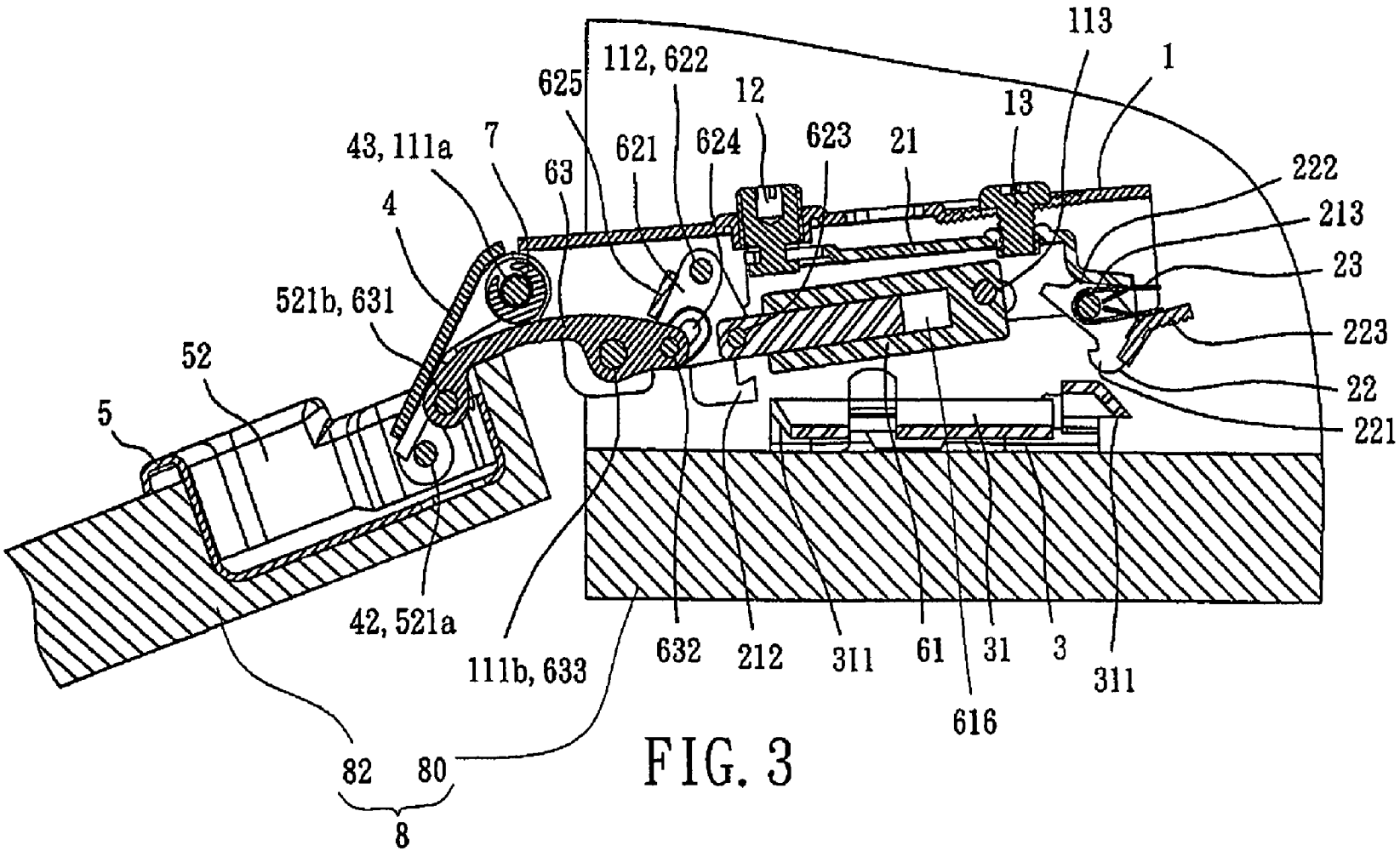
FIG. 3 shows a cross sectional view illustrating mounting of the hinge of FIG. 1 to the furniture of FIG. 2.
Figure 4:
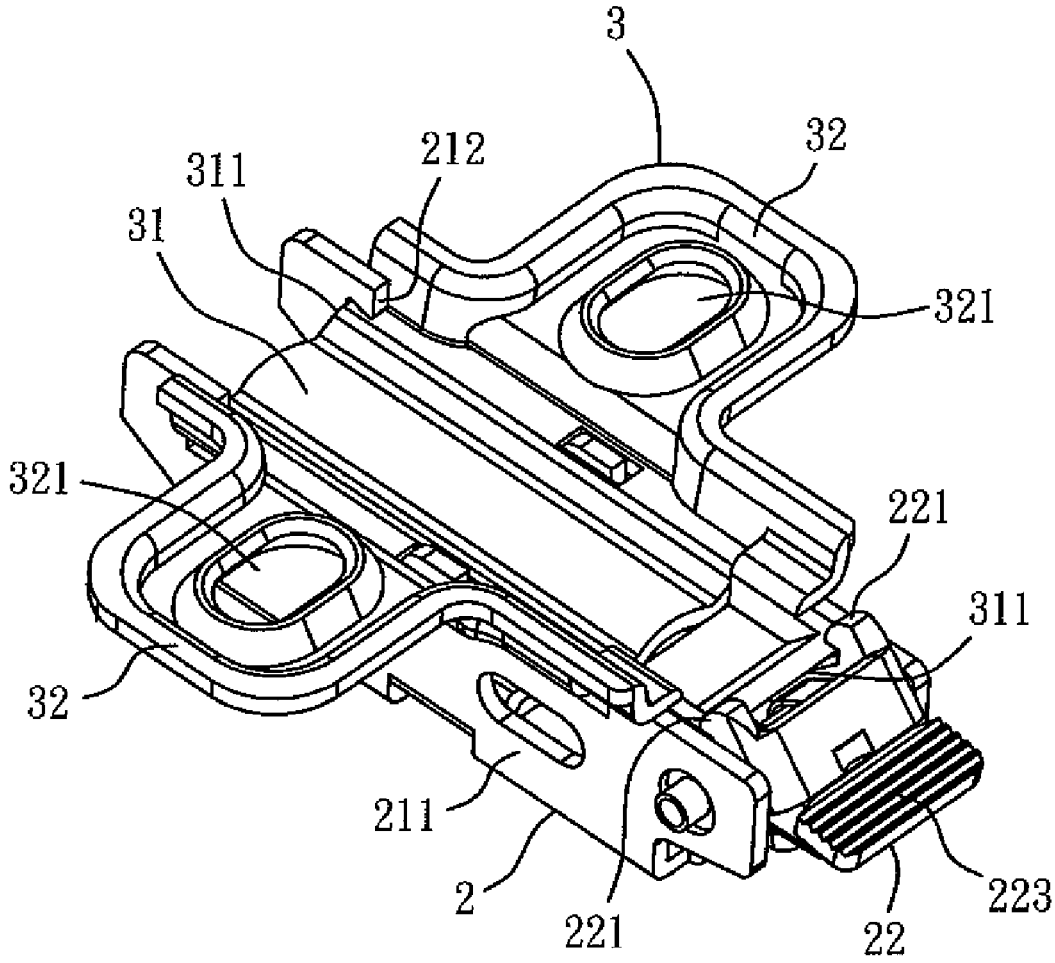
FIG. 4 shows a bottom, perspective view of a coupling device and a mounting seat of the hinge of FIG. 1.

With reference to FIGS. 2-4, after the mounting seat 3 and the fixed seat 5 are mounted onto the cabinet body 80 and the door 82 of the furniture 8, the door 82 can be rapidly assembled on the cabinet body 80. Specifically, the hooks 212 of the inner seat 21 of the coupling device 2 are engaged with one of the retaining portions 311 of the mounting seat 3. The buffer 61 of the buffer device 6 is received in the receiving portion 31 of the mounting seat 3. The hooks 221 of the coupling member 22 are engaged with the other one of the retaining portions 311 of the mounting seat 3. The assembly between the door 82 and the cabinet body 80 of the furniture 8 is thus completed. On the other hand, when it is desired to detach the door 82 from the cabinet body 80, one can press the pressing board 223 of the coupling member 22 so that the coupling member 22 is pivoted with respect to the pivot holes 224 of the coupling member 22 until the hooks 221 are disengaged from the retaining portion 311 of the mounting seat 3. In this state, the base 1 can be detached from the seat 3 to allow detachment of the door 82.

Figure 5:
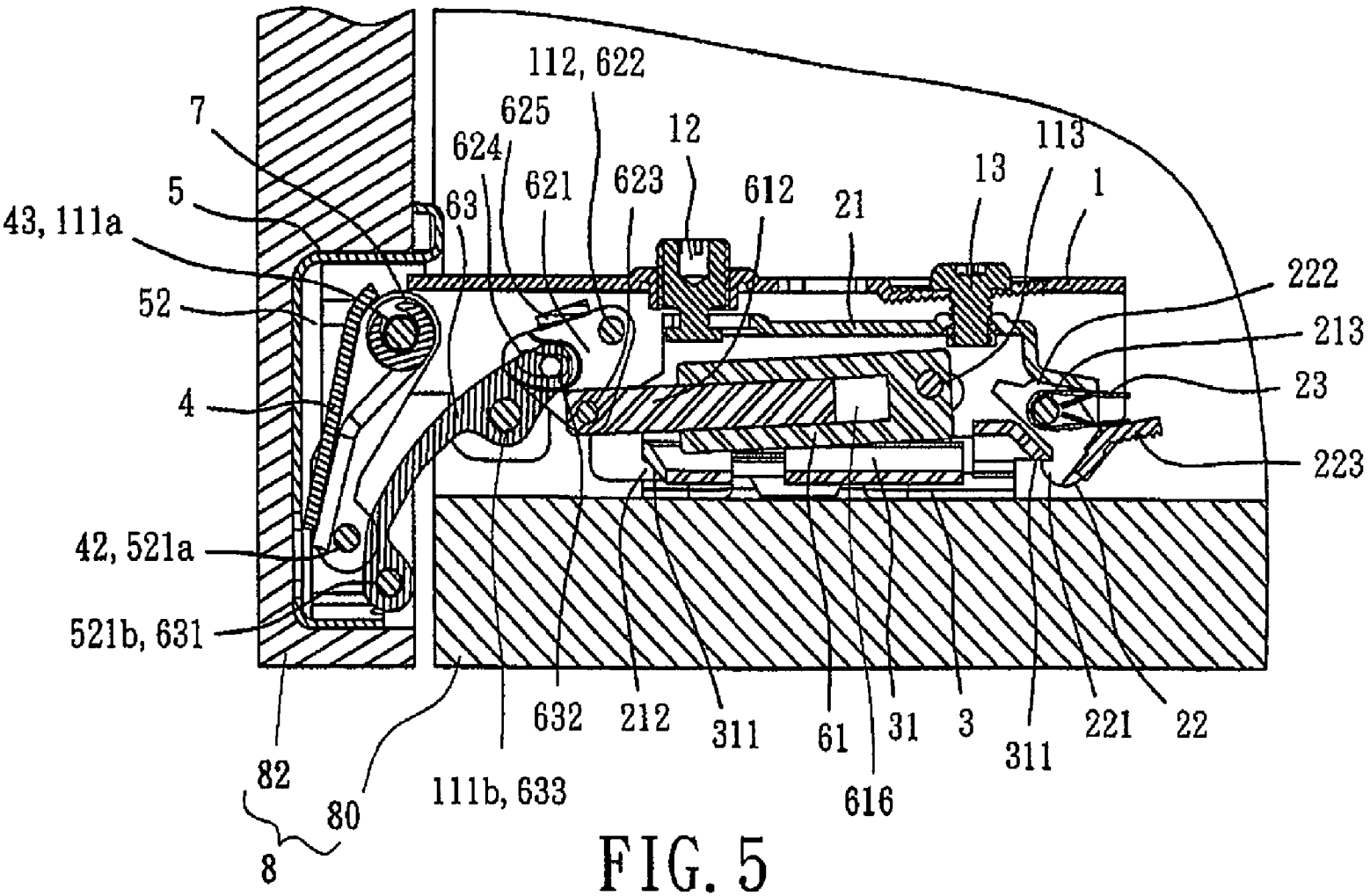
FIG. 5 shows a cross sectional view of the hinge of FIG. 1 and the portion of the furniture with the door in a closed position.

With reference to FIGS. 2 and 5, when the door 82 is moved relative to the cabinet body 80 to a closed position, the outer resilient plate 4 and the inner resilient plate 63 of the buffer device 6 are pivoted into the groove 52 of the fixed seat 5. The buffer 61 of the buffer device 6 provides a buffering effect to reduce the speed the door 82 is being closed. Furthermore, the inner resilient plate 63 of the buffer device 6 is pivoted with respect to a pivot axis defined by the pivot 15 extending through the fulcrum pivot holes 633, which, in turn, pivots the connecting member 62 with respect to the pivot 16 extending through the connecting member pivot holes 112. Since the pivot 65 providing a pivotal connection between the connecting member 62 and the inner resilient plate 63 is slideably received in the arcuate slots 624 of the connecting member 62, a portion of the pivotal movement of the buffer 61 can be converted into sliding movement of the pivot 65 along the arcuate slots 624 to reduce the pivotal angle of the buffer 61.

According to the above, by providing the connecting member 62 having the arcuate slots 624 to receive the pivot 65 that provides the pivotal connection between the connecting member 62 and the inner resilient plate 63, the pivotal angle of the buffer 61 can be reduced, and the overall size of the hinge according to the preferred teachings of the present invention can be smaller. Furthermore, the hinge according to the preferred teachings of the present invention is simple in structure and allows easy assembly by providing the connecting member 62 pivotably mounted between the buffer 61 and the inner resilient plate 63. Further, since there are only two pivotal connections between the buffer 61, the connecting member 62, and the inner resilient plate 63 and since the connecting member 62 is pivotably mounted onto the base 1 and limited to a fixed angular movement, the interference between the pivotal connections is avoided.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A binge comprising: a base including a pivotal portion;

a coupling member received in the base;

a mounting seat, with the coupling member detachably mounted onto the mounting seat;

an outer resilient plate including an end pivotably mounted onto the base;

a fixed seat pivotably mounted onto another end of the outer resilient plate; and a buffer device including a connecting member, a buffer, and an inner resilient plate, with the connecting member including a first connecting plate having a first pivot hole, a second pivot hole, and an arcuate slot, with the first pivot hole, the second pivot hole, and the arcuate slot being non-colinear, with each of the first pivot hole of the connecting member, an end of the buffer, and an end of the inner resilient plate being pivotably mounted onto the pivotal portion of the base, with another end of the buffer being pivotably mounted onto the second pivot hole of the connecting member, with another end of the inner resilient plate slideably mounted onto the arcuate slot, with the inner resilient plate further including a fulcrum pivot hole intermediate the ends thereof, with the fulcrum pivot hole being pivotably mounted by a pivot onto the pivotal portion of the base.

2. The hinge as claimed in claim 1, with the connecting member further including a second connecting plate identical to the first connecting plate, with the connecting member further including an intermediate plate interconnected between the first and second connecting plates, and with the first and second connecting plates having a spacing therebetween.

3. The hinge as claimed in claim 1, further comprising: a spring mounted between a pivotal connection between the base and the outer resilient plate.

4. The hinge as claimed in claim 1, with the base including two lateral walls forming the pivotal portion, and with the connecting member, the buffer, and the inner resilient plate pivotably mounted between the two lateral walls of the base.

5. The hinge as claimed in claim 1, with the coupling member including at least two first hooks facing inward, with the mounting seat including at least two retaining portions, with said at least two first hooks removably engaged with said at least two retaining portions.

6. The hinge as claimed in claim 5, further comprising: a coupling device including an inner seat, the coupling member, and a resilient member, with the inner seat received in the base, with the inner seat including an end having at least one second hook, with the inner seat further including another end pivotably mounted onto the coupling member, with said at least one second hook of the inner seat facing said at least two first hooks of the coupling member, with the resilient member mounted onto a pivotal connection between the inner seat and the coupling member and biasing said at least two first hooks toward the inner seat.

7. The hinge as claimed in claim 6, with the inner seat including two lateral walls each having the end, with said at least one second hook of the inner seat including two second hooks respectively formed on the ends of the lateral walls of the inner seat, with said at least two first hooks of the coupling member including two first hooks, with the coupling member further including two lugs and a pressing board, with the two lugs of the coupling member pivotably mounted onto the other ends of the two lateral walls of the inner seat, and with the pressing board facing outward of the inner seat.

8. The hinge as claimed in claim 7, with said at least two retaining portions respectively located on two ends of the mounting seat.

9. The hinge as claimed in claim 6, further comprising: an adjusting member and a fixing member mounted between the base and the inner seat, allowing adjustment in relative position between the base and the inner seat.

* * * * *